United States Patent [19]

Takahashi et al.

[11] Patent Number: 4,596,240

[45] Date of Patent: Jun. 24, 1986

[54] INSTRUMENTS FOR RECOVERING FUNCTIONS OF CARPAL JOINT, HAND AND FINGERS

[75] Inventors: Shiro Takahashi; Toshio Mikiya, both of Tokyo, Japan

[73] Assignee: Man Design Co., Ltd., Tokyo, Japan

[21] Appl. No.: 550,534

[22] Filed: Nov. 10, 1983

[30] Foreign Application Priority Data

Nov. 12, 1982 [JP] Japan ..... 57-170503[U]

[51] Int. Cl.[4] ..... A61H 1/02; A63B 21/00

[52] U.S. Cl. ..... 128/26; 272/130

[58] Field of Search ..... 128/26; 272/67, 68, 272/130; 273/67 B

[56] References Cited

U.S. PATENT DOCUMENTS 3,581,740 6/1971 Sherbourne ..... 128/DIG. 20 X
3,937,215 2/1976 Barthlome ..... 128/26
4,522,196 6/1985 Hasegawa ..... 128/26

FOREIGN PATENT DOCUMENTS 0486552 4/1918 France ..... 128/26

*Primary Examiner*—Richard J. Apley
*Assistant Examiner*—Kathleen J. D'Arrigo
*Attorney, Agent, or Firm*—Birch, Stewart, Kolasch & Birch

[57] ABSTRACT

An instrument for recovering the functions of the carpal joint, the hand and the fingers including a ballonet operatively connected to an air supply for subjecting the ballonet to repeated expansion and contraction by feeding and discharging compressed air thereto. Finger-engaging members being provided on the outer surface of the ballonet. Fastening members being provided on the outer surface of the ballonet for fixation of the carpal joint region and the region adjacent thereto. An individual's hand positioned within the finger-engaging members and the fastening members is extended and fanned as the ballonet is inflated and contracted as the ballonet is deflated.

3 Claims, 4 Drawing Figures

INSTRUMENTS FOR RECOVERING FUNCTIONS OF CARPAL JOINT, HAND AND FINGERS

BRIEF DESCRIPTION OF THE INVENTION

1. Field of the Invention

The present invention relates to an instrument for recovering the functions of the carpal joint, the hand and the fingers which are functionally disordered incidentially by motor paralysis, hypaesthesis and paraesthesia attributable to disorders of the brain, pith and nervous systems or to rheumatism.

2. Description of Background Art

Passive movement treatments or active movement-inducing treatments have locally been applied directly to the disfunction of the terminal joints of the forelimbs such as the hand or the fingers caused by disorders of the brain, pith and nervous systems, optionally with training instruments but without recourse to medicines or operations. In many cases, these treatments have been found to be effective. In particular, for the disfunction of the forelimbs associated with motor paralysis, hypaesthesis and contraction are inevitable, from both the physical and mental standpoints. The function recovery treatments applied for maintenance and strengthening of muscular power and stamina and for the maintenance and recovery of movability and harmony, smooth motion are necessary. In the passive movement treatments and active movement-inducing treatments, the amount and degree of movement should continuously be determined over extended periods of time depending upon the aspect of disfunction. In addition, it is necessary to select treatment equipment suitable for various cases.

However, the convention function recovery instruments utilizing air pressure, springs, etc. require complicated control systems and troublesome handling for application to various cases where there are considerable differences from person to person. Thus, they have limited use and offer a disadvantage in view of the cost. In the prior art, there is a great deal to be desired with respect to efficiency.

SUMMARY AND OBJECTS OF THE INVENTION

The present invention has for its main object to provide an instrument for recovering the functions of the forelimbs regions such as the carpal joint, the hand and the fingers which are functionally disordered, whereby passive movement or active movement-inducing treatments such as extension or fanning is selectively applied to the forelimbs by using the action of compressed air pressures to treat the disfunction, such as motor paralysis, hypaesthesis and contraction, of the forelimbs regions and prevent and cure the deformation thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
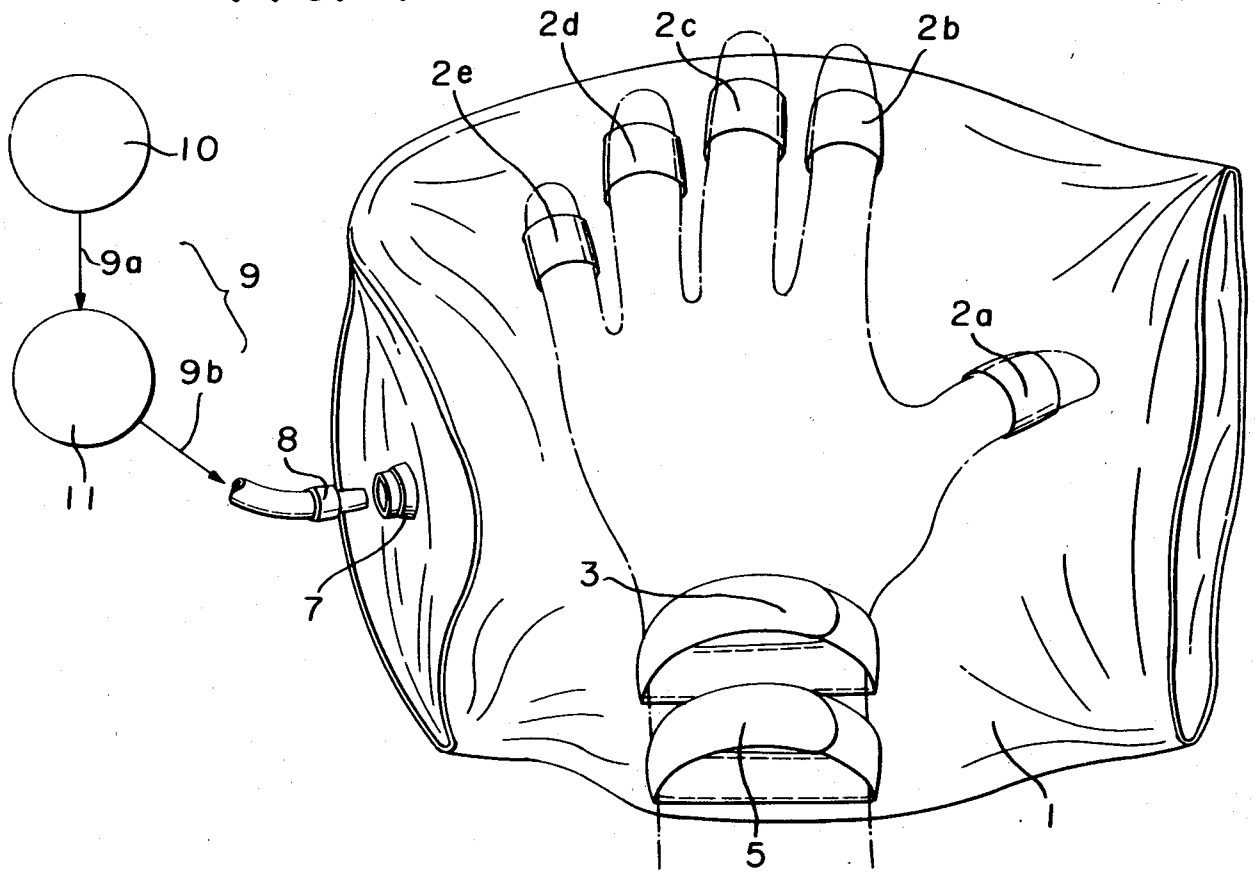
FIG. 1 is a view illustrative of the contracted ballonet when not in use.

Referring to the drawings, a ballonet 1 is inflated into a substantially cylindrical shape by utilizing compressed air. The ballonet 1 is formed of an airtight sheet material having sufficient flexibility but low contractibility. The ballonet 1 is circularly provided on the surface with finger-engaging means 2*a*–2*e*.

The embodiment shown in FIG. 1 is designed for the right hand. According to this embodiment, the finger-engaging means 2*a*–2*e* are located at positions where the first phalanges or the first interphalangeal joints of the respective fingers or the regions near thereto are fixed in place when the back of the hand is put over the ballonet 1 with the fingers being fanned. The finger-engaging means 2*a*–2*e* are arranged on the surface of the ballonet 1 in a substantially arcuate configuration. A space between the finger-engaging means 2*a* and 2*b* for the thumb and the index finger is somewhat larger than the space between the finger-engaging means 2*b* and 2*c*, 2*c* and 2*d*, 2*d* and 2*e* for the index finger and the middle finger, the middle finger and the medical finger, and the medical finger and the little finger, respectively.

Fastening members or bands 3 and 5 are provided to fasten the carpal joint and the arm region near the wrist to the surface of the ballonet 1. The fastening bands 3 and 5 are sufficiently spaced away from the finger-engaging means 2*a*–2*e*, and are disposed in parallel with each other. The fastening bands 3 and 5 are each formed on a pair of band pieces 3*a* and 3*b* or 5*a* and 5*b*. One portion of each of the band pieces 3, 5 is fixed to the surface of the ballonet 1 with the free ends being provided with connecting means 4*a* and 4*b* or 6*a* and 6*b*, respectively, so that they are detachably connected with each other to form a loop. It is preferred that the connecting means 4*a*, 4*b* and 6*a*, 6*b* are constructed as planar fasteners of the pressure fit type so as to accommodate the thickness of the arm region in the vicinity of the carpal joint, to which the bands 3 and 5 are fastened. The length of the connecting means 4*a*, 4*b*, 6*a* or 6*b* is such that the carpal joint and the arm region are surrounded thereby with sufficient room.

Figure 2:
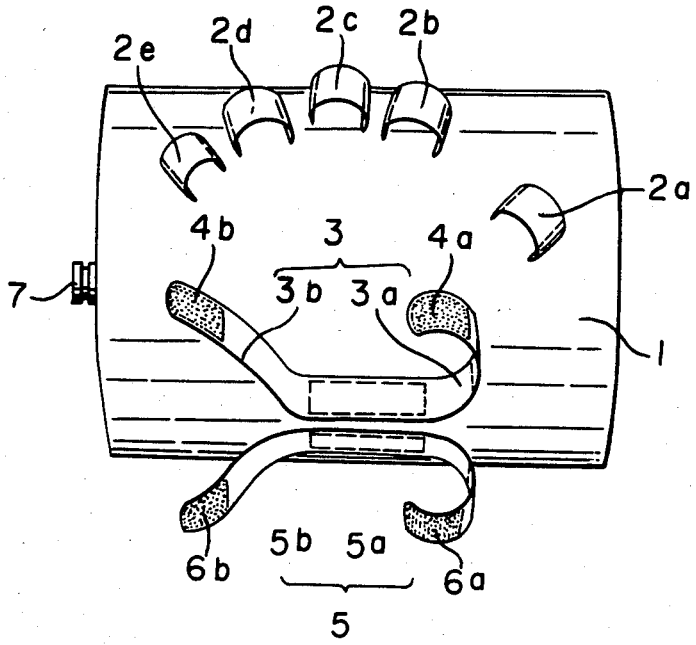
FIG. 2 is a plan view showing the inflated ballonet when not in use.

As illustrated in FIG. 2, each of two bands 3 and 5 is connected at its central portion with the surface of the ballonet 1 with both its free ends being connected with each other to form a loop. It is understood, however, that separate band pieces are bonded at one end to the surface of the ballonet 1 to form to fastening bands 3 and 5. While two bands 3 and 5 are arranged in parallel with each other in this embodiment, no limitation is imposed upon the number of the fastening bands. One or three or more fastening bands may be used depending upon the size of the ballonet 1, etc.

A socket 7 is disposed on one side of the ballonet 1 for supplying and discharging compressed air. Compressed air is supplied from a compressed air generating source 10, hereinafter referred to as the air source, into the ballonet 1 by inserting into the aforesaid socket 7 a plug 8 disposed at the end of a compressed air feeder pipe 9.

The feeder pipe 9 extending from the air source 10 is provided on a suitable portion with a fluid switch 11 for the adjustment of the flow rate of the air fed or for maintaining or cutting off an air flow passing through the feeder pipe 9. It is preferred that the fluid switch 11 is of the type which does not only serve to adjust the flow rate of air but is also designed to prevent any overload from being applied to the air source 10 during cutting-off of compressed air.

Figure 4:
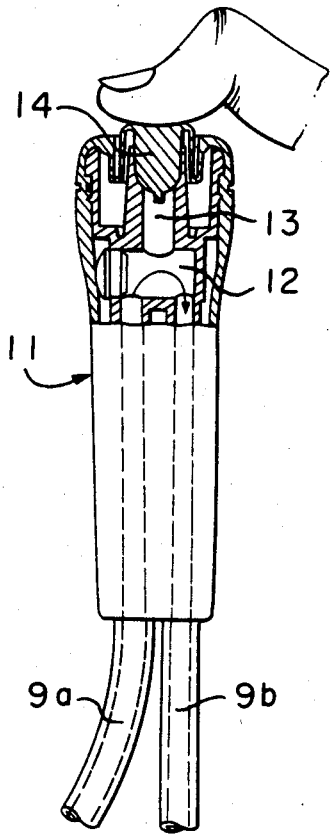
FIG. 4 is a view illustrative of the fluid switch.

For example, a fluid switch as illustrated in FIG. 4 is employed. As illustrated, the fluid switch 11 is designed to feed compressed air from a feeder pipe portion 9*a* into a distribution chamber 12, from which the air is supplied into the ballonet 1 through a discharge pipe portion 9. The distribution chamber 12 is provided with a discharge pipe 13 having therein an upper opening. Only when the upper opening in the discharge pipe 13 is closed may compressed air flow from the pipe 9*a* to 9*b*. To close the upper opening in the discharge pipe 13, a valve 14 is forced thereinto, as illustrated.

Upon removal of a given force, the valve 14, which is resiliently supported in place, disengages out of the opening. If a load is applied to the air feed side of the pipe portion 9*b* in this state, most of the compressed air from the pipe portion 9*a* is discharged to the outside through the upper opening in the discharge pipe 13 without flowing into the pipe portion 9*b*. In this manner, a space between the upper opening in the discharge pipe 13 and the valve 14 can be adjusted by forcing the valve 14 into said opening. Thus, it is possible to optionally conduct or cut off a fluid flow or adjust the flow rate thereof, thereby making it possible to adjust the expansion and inflation of the ballonet 1 connected with the feeder pipe 9.

Figure 3:
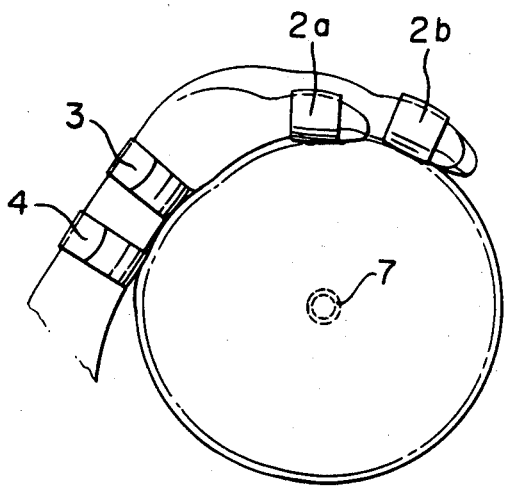
FIG. 3 is a side view showing the inflated ballonet when in use.

The embodiment as described above operates as follows:

In use, the plug 8 mounted at the end of the feeder pipe 9 extending from the air source 10 is inserted into the socket 7 of the ballonet 1. The back of the functionally disordered hand is positioned over the surface of the ballonet 1 now in a contracted state, and the respective fingers are inserted through the finger-engaging means 2*a*–2*e* provided on the surface of the ballonet 1. The wrist region and the arm region are then wound with the fastening bands 3 and 5 with the connecting members 4*a*, 4*b* and 6*a*, 6*b* being connected with each other. In this manner, the back of the hand is fixedly brought into close contact with the surface of the ballonet 1. In this state, the air source 10 is driven, and compressed air is fed into the ballonet 1 by manipulation of the fluid switch 11 to expand the ballonet 1. As the ballonet 1 expands, the hand is warped toward the back thereof, as illustrated in FIG. 3, so that the muscle, tendon, joint, etc. of the hand are sufficiently extended. When the fluid switch 11 is off, the supply of compressed air into the ballonet 1 is interrupted and, at the same time, the compressed air introduced into the ballonet 1 flows backward and is discharged through the upper opening in the discharge pipe 13. As a result, the ballonet 1 contracts gradually.

Repetition of the aforesaid operation results in repeated expansion and contraction of the ballonet 1, whereby the back of the hand and the fingers are aggressively extended and fanned from the back side of the hand.

As mentioned above, the present invention provides an instrument for recovering the functions of the carpal joint, the hand and the fingers, which comprises a ballonet subjected to repeated expansion and contraction by feeding and discharging of compressed air. Finger-engaging means are provided on the outer surface of the ballonet and fastening members are provided on the outer surface of the ballonet for fixation of the carpal joint region and the region near thereto. An individual's hand applied over the ballonet is extended and fanned toward the back thereof.

According to the present invention, the functionally disordered forelimbs regions including the hand, the fingers and the carpal joint are fixed to the surface of the ballonet which is repeatedly expanded and contracted by feeding and discharging of compressed air, whereby the hand is effectively expanded and fanned. In particular, the treatment and function recovery training of the hand suffering from paralysis, hypaesthesis, paraesthesia and contraction are effectively carried out by passive movement and active movement-inducing treatment for function recovery. Furthermore, the operation of the instrument and the hand are visually observed during training. The hand can be warped toward the palm thereof by, e.g., applying the left hand over the instrument for the right hand.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An instrument for treating the carpal joint, hand and fingers, comprising a fluid-tight flexible ballonet connected to a fluid source through a fluid switch and adapted to be selectivity expanded and contracted by supplying and discharging compressed air into and out of said ballonet, said ballonet being arranged, when inflated, to assume a generally cylindrical configuration and extend over substantially the entire back of the hand and the exterior portion of the wrist;

five finger-engaging members positioned and attached to the exterior surface of said ballonet for engaging and holding the five fingers individually in spread-apart relation with their backs against said ballonet; and fastening means attached to the exterior surface of said ballonet for fastening the carpal joint and a region in the vicinity thereof, whereby said ballonet is operative, when inflated, to warp the hand backwards to thereby straighten the contracted finger joints and carpal joint, and whereby, in use repeated supplying and discharging of compressed air into and out of said ballonet will effect rhythmical and intermittent movement, such as fanning and extension of the functionally disordered carpal joint, hand and/or fingers to provide for the recovery of normal flexion, contraction and extension functions.

2. An instrument according to claim 1, wherein said air supply means includes a fluid switch for selectively supplying compressed air to and selectively venting compressed air from said ballonet.

3. An instrument according to claim 1, wherein said fastening members include at least two bands operatively connected to said ballonet for selectively securing an individual's carpal joint region thereto.

* * * * *